US007785217B2

(12) United States Patent
Ladd et al.

(10) Patent No.: US 7,785,217 B2
(45) Date of Patent: Aug. 31, 2010

(54) GOLF BALL WITH INTERMEDIATE LAYER CONTAINING AN EXPANDABLE POLYMER

(75) Inventors: Derek A. Ladd, Acushnet, MA (US); Matthew F. Hogge, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/467,644

(22) Filed: May 18, 2009

(65) Prior Publication Data

US 2009/0221386 A1 Sep. 3, 2009

Related U.S. Application Data

(62) Division of application No. 11/106,926, filed on Apr. 15, 2005, now Pat. No. 7,549,936.

(51) Int. Cl.
*A63B 37/06* (2006.01)

(52) U.S. Cl. ..... 473/373

(58) Field of Classification Search ..... 473/373, 473/374

See application file for complete search history.

(56) References Cited

U.S. PATENT DOCUMENTS

| | | | |
|---|---|---|---|
| 3,615,972 | A | 10/1971 | Morehouse et al. |
| 4,016,110 | A | 4/1977 | Cohrs et al. |
| 4,094,685 | A | 6/1978 | Lester et al. |
| 4,495,227 | A | 1/1985 | Tanaka |
| 5,823,889 | A | 10/1998 | Aoyama |
| 5,849,168 | A | 12/1998 | Lutz |
| 5,911,904 | A | 6/1999 | Shih et al. |
| 5,919,100 | A | 7/1999 | Boehm et al. |
| 6,149,535 | A | 11/2000 | Bissonnette et al. |
| 6,475,104 | B1 | 11/2002 | Lutz et al. |
| 6,494,795 | B2 | 12/2002 | Sullivan |
| 6,511,388 | B1 | 1/2003 | Dewanjee |
| 6,632,147 | B2 | 10/2003 | Cavallaro et al. |
| 6,685,580 | B2 | 2/2004 | Sullivan |
| 6,743,123 | B2 | 6/2004 | Sullivan |
| 6,786,837 | B2 | 9/2004 | Dewanjee et al. |
| 6,793,867 | B2 | 9/2004 | Dewanjee |
| 6,806,347 | B2 | 10/2004 | Hogge et al. |
| 6,852,042 | B2 | 2/2005 | Sullivan et al. |
| 2002/0058721 | A1 | 5/2002 | Pachl et al. |
| 2003/0109391 | A1 | 6/2003 | Midha et al. |
| 2004/0048688 | A1 | 3/2004 | Hogge et al. |
| 2004/0180093 | A1 | 9/2004 | Burton et al. |

FOREIGN PATENT DOCUMENTS

| | | |
|---|---|---|
| WO | WO00/23519 | 4/2000 |
| WO | WO01/29129 | 4/2001 |

*Primary Examiner*—Raeann Trimiew
(74) *Attorney, Agent, or Firm*—Margaret C. Barker

(57) ABSTRACT

A multilayer golf ball with at least one layer made from an expandable polymeric composition is disclosed. In accordance to one aspect of the invention, the expandable polymeric composition comprises a film-forming binder polymer latex, a dispersing agent, a plurality of polyspheres encapsulating expandable volatile substance, and at least one additive. The additive can be a defoaming agent, a solvent, a thickener, a plasticizer, or any combination thereof. The at least one layer may also comprise a thermally expandable microsphere encapsulating foaming agent. Another expandable polymeric composition comprises a curable silicone composition comprising a liquid diorganopolysiloxane, a liquid organosilicon compound, a condensation catalyst and a blowing agent. Another the expandable polymeric composition comprises an aqueous acrylic based latex emulsion and an unencapsulated blowing agent.

10 Claims, No Drawings

GOLF BALL WITH INTERMEDIATE LAYER CONTAINING AN EXPANDABLE POLYMER

CROSS REFERENCE

This application is a divisional of U.S. patent application Ser. No. 11/106,926, filed Apr. 15, 2005 now U.S. Pat. No. 7,549,936.

FIELD OF THE INVENTION

The present invention relates to a multilayer golf ball, and more particularly to a multilayer golf ball with an expandable polymer as an intermediate layer.

BACKGROUND OF THE INVENTION

Conventional golf balls include multi-layer balls, which may have one or more wound layers. The difference in playing characteristics is significant among the three different types of balls: two-piece balls, wound balls and multi-layer balls. Two-piece balls are typically made with a single solid core encased by a cover material. These balls are generally most popular among recreational golfers, because they are durable and provide maximum distance. Typically, the solid core is made of polybutadiene chemically cross-linked with zinc diacrylate and/or similar cross-linking agents. The cover material comprises tough, cut-proof blends of one or more ionomers, such as SURLYN® sold commercially by DuPont or IOTEK® sold commercially by Exxon.

Wound balls typically have either a solid rubber or liquid-filled center, around which many yards of a stretched elastic thread or yarn are wound to form a core. The wound core is then covered with a durable ionomer cover, or a softer cover such as balata, polyurethane or polyurea. Wound balls are generally softer than two-piece balls and can provide more spin, thus enabling skilled golfers to have more control over the ball's flight and placement.

Solid multi-layer golf balls may have one or more core layers, one or more intermediate layers and one or more cover layers. They are designed to overcome some of the undesirable features of conventional two-piece balls, such as hard feel, while maintaining the positive attributes of wound balls, such as increased initial velocity and distance. It is also desirable that multi-layer balls have similar "click and feel" and spin characteristics of wound balls.

Solid multi-layer golf balls can be produced using a variety of manufacturing techniques. For example, two or more cover layers may be molded around a conventional core with one or more intermediate layers interposed between the cover layers and the core. Alternatively, multi-layer balls may be formed from cores having more than one core layers and may optionally contain one or more intermediate and/or cover layers. Multi-layer balls may even comprise a conventional wound core around which at least one intermediate layer and/or at least one cover layer are formed. Typically, the outer layers of multi-layer golf balls are formed by molding them around the core or the preceding intermediate layer or cover layer. Conventional techniques for applying such layers include injection molding, compression molding and casting the layer material around the preceding core or layer.

Intermediate layers have been used as water vapor barrier layer, as disclosed in U.S. Pat. No. 6,632,147, and as thin layer of either high density or low density to alter the rotational moment of inertia of the ball, as disclosed in U.S. Pat. Nos. 6,494,795, 6,685,580 and 6,852,042. Intermediate layers can also be non-continuous or do not completely cover the core, as disclosed in U.S. Pat. No. 6,743,123.

U.S. Pat. No. 6,793,867 teaches a method of manufacturing golf balls that prevents the cover from cracking due to thermal expansion of the core and/or the intermediate layer caused by the exothermic reaction released during the formation of the cover. However, there is no known disclosure that teaches the expansion of the intermediate layer to impart desirable property(ies) to the golf ball.

SUMMARY OF THE INVENTION

The invention is directed to a multilayer golf ball comprising a core, an intermediate layer, and a cover, wherein the intermediate layer is made from an expandable polymeric composition with a thickness of 0.001 inch to 0.020 inch, when expanded. The intermediate layer can include multiple sub-layers. The polymeric composition expands when exposed to a triggering environmental factor, such as heat or low pressure.

In one embodiment, the expandable polymeric composition comprises a film-forming binder polymer latex, a dispersing agent, a plurality of microspheres or polyspheres encapsulating expandable volatile substance, and additives.

The film-forming binder polymer latex can be polytheylene, polypropylene, polyethylene vinyl acetate, natural rubber, 1,4 polyisoprene, polyacrylonitrile, polyvinyl fluoride, polyvinylidene chloride, polyvinylidene fluoride, polymonochloride, fluoroethylene, polytetrafluorethylene, polychloroprene, acrylonitrile-butadiene-styrene terpolymer, polyvinyl butyral, polystyrene, polyvinyl acetate, polyvinyl alcohol, poly-a-methyl styrene copolymer, butadiene-styrene, polymethacrylate, polymethyl-a-cyanoacrylate, ethyl vinyl ether and maleic anhydride, polymethyl-vinylether, copolymer of styrene and ethyl acrylate, copolymer of styrene and vinylidene chloride, polyvinylidene chloride, copolymer of butylacrylate and vinylacetate, copolymer of 2-ethyl hexylacrylate, copolymer of methyl methacrylate and ethylacrylate, copolymer methylmethacrylate and acrylonitrile butylacrylate, terpolymer of acrylinitrile vinylacetate 2-ethylhexylacrylate, terpolymer of acrylonitriles vinylacetate acrylonitriles, terpolymer of butylacrylate ethylacrylate acrylonitrile, copolymer of vinylidene chloride and acrylonitrile, copolymers of vinylidene and ethyl acrylate, polyurethane, epoxies, polycarbonates, polyesters, polyamides, urea formaldehyde, or phenol-formaldehyde.

The dispersing agent can be chosen from benzylphenyldimethyl ammonium salt, nephlanic acid salt, alkylacrylsufonate, sulfamated oil, hydroxylakysulfamide, or hydroxyalkyl phosphate. The polyspheres can be polyspheres H, polyspheres BH, polyspheres BHS, or a combination thereof. The expandable volatile substance inside the polyspheres can be isobutane or benzene sulfohydrazide. The additive can be a defoaming agent, a bridge solvent, a thickener, a plasticizer, or a combination thereof.

Upon heating the expandable polymer composition, for example at about 100-180° C. for about 10-60 minutes may expand from about 5% to about 200%. Such expansion reduces the density or specific gravity of the intermediate layer to provide the golf ball with a relatively low rotational moment of inertia. Also, such expanded layer may serve as an impact modification layer to absorb the impact with golf clubs.

Other embodiments of the expandable polymeric composition include, but are not limited to, foamable silicone based curable composition and a foamable acrylic based latex emulsion and unencapsulated blowing agent.

DETAILED DESCRIPTION OF THE INVENTION

This invention is directed to a multilayer golf ball comprising a core, an intermediate layer that is formed with an expandable polymeric composition, and an outer cover layer. The intermediate layer may be an outer core layer, an inner cover layer or a mantle layer. The intermediate layer may comprise one or more layer. The core can be solid or wound, and may be liquid filled. The expandable polymeric composition can be expanded by heat, blowing agent or low pressure.

The solid core may comprise a single spherical element, or it may comprise an innermost spherical element with one or more intermediate layers surrounding the inner spherical element. The solid core can be made from any suitable and known core materials including cross-linked thermoset plastics, such as natural rubber, polybutadiene (PBD), polyisoprene, styrene-butadiene or styrene-propylene-diene rubber, and thermoplastics such as partially or fully neutralized ionomer resins, polyamides, polyesters, or a thermoplastic elastomer. Suitable thermoplastic elastomers include Pebax®, Hytrel®, thermoplastic urethane, and Kraton®, which are commercially available from Elf-Atochem, E.I. Du Pont de Nemours and Company, various manufacturers, and Shell Chemical Company, respectively. The core materials can also be formed from a castable material. Suitable castable materials include those comprising a urethane, polyurea, epoxy, silicone, IPN's, etc. Additionally, suitable core materials may also include a reaction injection molded polyurethane or polyurea, including those versions referred to as nucleated, where a gas, typically nitrogen, is essentially whipped into at least one component of the polyurethane, typically, the prepolymer, prior to component injection into a closed mold where essentially full reaction takes place resulting in a cured polymer having reduced specific gravity. These materials are referred to as reaction injection molded (RIM) materials.

The cover may comprise one or more layers. Its desired performance character is preferably to be tough, and resistant to cuts. It can be made from conventional materials that are suitable as golf ball covers. Suitable cover materials include partially or fully neutralized ionomer resins, such as Surlyn® available from DuPont, blends of ionomer resins, acrylic acid, methacrylic acid, thermoplastic rubber polymers consisting of block copolymers in which the elastomeric midblock of the molecule is an unsaturated rubber or a saturated olefin rubber, e.g., Kraton® rubbers available from Shell Chemical Co., polyethylene, and synthetic vulcanized rubber. High performance cover materials include thermoplastic or thermoset urethane, polyurea and natural rubber such as balata.

Suitable core and cover materials are fully disclosed in commonly-owned, co-pending application Ser. No. 11/061,260 filed on Feb. 18, 2005, entitled "Multi-layer Golf Ball Having Velocity Gradient from Faster Center to Slower Cover," and application Ser. No. 11/061,338 filed on Feb. 18, 2005, entitled "Multi-layer Golf Ball Having Velocity Gradient from Slower Center to Faster Cover.". The disclosures of these references are incorporated herein by reference in their entireties. Additional materials suitable for the core and the cover are described in U.S. Pat. No. 5,919,100 and international publications WO 00/23519 and WO 01/29129, and are incorporated by reference in their entireties. Preferably, the core is made from a polybutadiene rubber material, and the cover is made from a composition comprising a thermoset or thermoplastic urethane or a composition comprising an ionomer resin.

The intermediate layer is preferably made from an expandable polymeric material, also known in the art as expandable paint. As described in U.S. Pat. No. 4,094,685, incorporated by reference in its entirety, the expandable polymeric composition comprises a film-forming binder polymer latex, a dispersing agent, a plurality of polyspheres encapsulating expandable volatile substance, and at least one additive. The additive can be a defoaming agent, a bridge solvent, a thickener, a plasticizer, or any combination thereof.

The film-forming binder polymer latex is a polymer that is self-crosslinking, crosslinkable, or non-curing. Such binder polymer latex can also be used as a mixture of a copolymer and another polymer, e.g. as a mixture of copolymer of ethylacrylate and butylacrylate, or a mixture of a copolymer of butadiene and acrylonitrile. Examples of polymers that can be used as film-forming binder polymer latex include, but are not limited to, polytheylene, polypropylene, polyethylene vinyl acetate, natural rubber, 1,4 polyisoprene, polyacrylonitrile, polyvinyl fluoride, polyvinylidene chloride, polyvinylidene fluoride, polymonochloride, fluoroethylene, polytetrafluoroethylene, polychloroprene, acrylonitrile-butadiene-styrene terpolymer, polyvinyl butyral, polystyrene, polyvinyl acetate, polyvinyl alcohol, poly-a-methyl styrene copolymer, butadiene-styrene, polymethacrylate, polymethyl-a-cyanoacrylate, ethyl vinyl ether and maleic anhydride, polymethyl-vinylether, copolymer of styrene and ethyl acrylate, copolymer of styrene and vinylidene chloride, polyvinylidene chloride, copolymer of butylacrylate and vinylacetate, copolymer of 2-ethyl hexylacrylate, copolymer of methyl methacrylate and ethylacrylate, copolymer methylmethacrylate and acrylonitrile butylacrylate, terpolymer of acrylinitrile vinylacetate 2-ethylhexylacrylate, terpolymer of acrylonitriles vinylacetate acrylonitriles, terpolymer of butylacrylate ethylacrylate acrylonitrile, copolymer of vinylidene chloride and acrylonitrile, copolymers of vinylidene and ethyl acrylate, polyurethane, epoxies, polycarbonates, polyesters, polyamides, urea formaldehyde, and phenol-formaldehyde.

The dispersing agents, or dispersants, are effective in dispersing polyspheres in the composition. Examples of dispersing agents include, but are not limited to, benzylphenyldimethyl ammonium salts, nephlanic acid salts, alkylacrylsufonates, sulfamated oils, hydroxylakysulfamide, and hydroxyalkyl phosphates.

The microspheres or polyspheres are encapsulations of at least one expandable volatile substance in a monomeric film-forming polymer dispersed within the film-forming binder polymer latex. The encapsulated expandable volatile substance can either be a volatile liquid, such as isobutene, liquefied hydrocarbons or gas-producing solid, such as benzene sulfohydrazide. Preferably, the volatile liquids and the gas-producing solids be hydrophobic, so that these hydrophobic compounds are formed into a fine emulsion or dispersion "seed." This "seed" serves as the site for emulsion polymerization, whereby the monomeric ingredients, which are added to the batch or added by delayed addition are polymerized around the "seed" completely encapsulating it. Suitable polyspheres include, but are not limited to, polyspheres H, polyspheres BH, polyspheres BHS, or a combination thereof.

Polyspheres H are prepared by reacting 100 parts of demineralized water, containing 15 parts of colloidal silica, 15 parts of benzene sulfohydrazide (Nitropore OBSH from Stepan Chemical, Wilmington, Mass.) 2.8 parts of hydroxyl ethyl phosphate, an encapsulating film forming polymer made from 100 parts of vinylidene chloride, 15 parts acrylonitrile, 5 parts of methacrylic acid, 5 parts of ethyl acrylate, and 0.4 parts of benzoly peroxide.

Polyspheres BH are prepared by reacting 100 parts of demineralized water, 14 parts of colloidal silica, 8 parts of benzene sulfohydrazide (Nitropore OBSH) 8 parts of Isobutane, 1.5 parts hydroxyl ethyl phosphate, 2.5 parts of nonionic surfactant (Igepal CO880 from GAF Chemical Corp.)

Polyspheres BHS are prepared by reacting 100 parts of demineralized water, 12 parts of colloidal silica, 12 parts of benzene sulfohydrazide (Nitropore OBSH) 4 parts of isobutane, 1.75 parts of hydroxy ethyl phosphate, 2.3 parts of n-octyl phenol ethylene oxide condensate (Igepal CO 730), 80 parts of vinylidene chloride, 15 parts of butyl acrylate, 5 parts of acrylonitrile, 0.5 parts of methacrylic acid, and 0.6 parts of benzoyl peroxide catalyst.

Other suitable microspheres encapsulating volatile fluid include, but are not limited to, those described in U.S. Pat. Nos. 3,615,972 and 4,016,110, which are incorporated herein by reference in their entireties. These microspheres are typically made from thermoplastic shells encapsulating a liquid blowing agent.

The defoaming agent is used to prevent excessive foam development in handling the compositions and mixing it into other mediums. The bridge solvent is an agent which brings together two phases of a mixture which would not normally come together to form a homogeneous mixture. It is incorporated into the composition to provide compatibility with mixtures into which the composition will be admixed, and to give wetting upon many diverse surfaces into which the expandable art medium might be applied. In the preferred embodiment, the bridge solvent has a low boiling point, is not encapsulated in the polyspheres, and provides for the wetting of the various ingredients. An example of bridge solvent is butylene glycol. Thickener increases the viscosity of the composition to the desired level. It also gives stability upon admixing with other mediums, maintains suspending action to the polyspheres in the composition, and develops proper application consisting of the resultant expandable art medium. Alternatively, a plasticizer can be added to the composition to modify the composition. For example, in conjunction with other additives such as extenders, drying oils, fillers, optical brighteners, catalysts, pigments, dyes, coloring compounds, surfactants, thickeners and the like, plasticizer can be formulated to give functional, decorative surfaces, giving rise to special effects. An example of a plasticizer can be a terpolymer latex comprising 30 parts 2-ethyl hexylacrylate, 30 parts butylacrylate, and 40 parts of ethyl acrylate, at 50% solids.

The intermediate layer can also be made of other materials such as MICROPEARL™, which is thermally expandable microsphere encapsulating physical foaming agent available from products from Pierce and Stevens Corp. The use of different types of MICROPEARL™ has been described, e.g. F100D in U.S. Pat. App. Pub. 2004/0180093, and F30D in U.S. Pat. App. Pub. 2002/005872.

The method of applying expandable paint to the core of the multilayer golf ball can be carried out in several ways. Spraying is the preferred method of application, while dipping, casting and other known methods may also be employed. One preferred method of coating the core with the expandable paint or expandable polymeric composition is described in commonly owned, U.S. Pat. No. 5,849,168 entitled "Method of In-Mold Coating Golf Balls", which is incorporated by reference herein in its entirety. Other suitable coating methods are disclosed in commonly-owned U.S. Pat. App. Pub. No. 2004/0048688 entitled "Golf Ball with Vapor Barrier Layer and Method for Making Same." and U.S. Pat. No. 6,706,322 entitled "Method of Coating Thin-Layers on Golf-Balls." These references are also incorporated herein by reference in their entireties.

After the application of expandable paint or expandable polymeric composition, the coated particles can be heated at about 100° C. to about 180° C. for about 10 minutes to about 1 hour, depending on the materials selected. The expandable paint may expand from about 5% to about 200%, depending on the materials selected. The thickness of the layer of expandable paint can be in the range of about 0.001 inch to about 0.020 inch.

Another suitable expandable polymeric composition includes a foamable silicone-containing composition which comprises a curable silicone composition mainly composed of a liquid diorganopolysiloxane, a liquid organosilicon compound, a condensation catalyst and a blowing agent. This silicone based composition is available in liquid form and can be easily coated on to the core. Additionally, this composition is water repellant and can be used as a water vapor barrier layer. Such composition is disclosed in U.S. Pat. No. 4,495,227, which is incorporated herein by reference in its entirety.

The liquid diorganopolysiloxane has a substantially linear molecular structure having at least two functional groups bonded to the silicon atoms in a molecule as the base polysiloxane. These functional groups include silanolic hydroxy groups, and two alkenyl groups. Preferably, the functional groups in the base polysiloxane include hydroxy, vinyl, allyl, epoxy, and mercapto.

The liquid organosilicon compound has at least three functional groups bonded to the silicon atoms. These functional groups include hydrogen and hydrolyzable groups. Preferably, the functional groups in the liquid organosilicon compound include hydrogen, vinyl, allyl, alkoxy, acyloxy, oxime, aminoxy, and isopropenoxy.

The blowing agent is a low-boiling organic liquid encapsulated in a polyvinylidene chloride film in the form of microcapsules, in an amount from 1 to 200 parts by weight per 100 parts by weight of the curable silicone composition. Preferably, the blowing agent is a thermally decomposable organic blowing agent. More preferably, the blowing agent is water or an alcohol encapsulated with a silicone resin in the form of microcapsules.

Another suitable expandable polymeric composition includes an aqueous acrylic based latex emulsion and an unencapsulated chemical blowing agent. The blowing agent comprises azodicarbonamide, pip-oxybis benzene sulfonyl hydrazide, p-toluene sulfonyl hydrazide or combination thereof. This composition is also available in liquid form and can be easily coated on to the core. Additionally, this composition is water repellant and can be used as a water vapor barrier layer. This expandable composition is disclosed in U.S. Pat. No. 5,911,904, which incorporated herein by reference in its entirety.

The aqueous acrylic latex emulsion and chemical blowing agent composition may further include one or more of an activator, e.g., zinc oxide, to enhance the foaming process, a wax emulsion and/or a thickener compound, e.g., cellulosic gum, urethane block copolymer, a synthetic clay mineral or combinations thereof. Preferably, the acrylic based latex emulsion is a copolymer of methyl methacrylate and butyl acrylate or a copolymer of methyl methacrylate and ethyl acrylate.

In one example, this composition includes 60-95 wt % of aqueous acrylic based latex emulsion, 1-25 wt % non-encapsulated chemical blowing agent, and 0.1-5 wt % thickener compound.

The intermediate layer made with expandable polymeric layer can be used as a boundary layer and allow the use of polyurethane and polyurea as covers over golf balls. In addition, it is an impact modification layer for the multilayer golf ball, making the ball more suitable for players of different levels of skills. Also, since the density of the intermediate layer decreases after expansion, the expandable intermediate layer can be used to provide the ball with lower rotational moment of inertia for higher spin rates. When expanded in some embodiments the expandable polymeric layer forms a foam, preferably a closed cell foam.

Preferably, a golf ball in accordance to the present invention comprises a solid or multilayer solid core having an outer diameter of greater than about 1.50 inches, more preferably 1.550 inches and most preferably 1.580 inches. The expandable intermediate layer is preferably less than about 0.030 inch thick, and more preferably ranges from 0.001 inch to about 0.020 inch. The cover is a urethane or urea cover with sufficient thickness to produce a 1.680 inch diameter golf ball.

For balls with wound core, the windings may be made from various threads including, but not limited to, natural rubber, polyether urea (sold as LYCRA® by DuPont), polyester urea, polyester block copolymers (sold as HYTREL® by DuPont), polyethylene, polyamide, polyketon, poly (p-phenylene terephthalamide) (sold as KEVLAR® by DuPont), polyisoprene, among others. The expandable intermediate layer may surround the wound core to minimize moisture from penetrating into the core. Since the expandable polymeric layer is in a liquid form when being applied to the core, the windings can be easily coated. Wound balls are disclosed in commonly-owned U.S. Pat. No. 6,149,535 entitled "Golf Ball with Spun Elastic Threads" and U.S. Pat. No. 6,475,104 entitled "Impregnated Wound Golf Ball and Methods of Forming Same." These references are incorporated herein by reference in their entireties.

Unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include slight variations of the numerical values discussed above. Hence, the numerical values stated above and claimed below specifically include those values and the values that are approximately or nearly close to the stated and claimed values. Therefore, it will be understood that the appended claims are intended to cover all such modifications and embodiments, which would come within the spirit and scope of the present invention.

What is claimed is:

1. A multilayer golf ball comprising a core, an intermediate layer, and a cover, wherein the intermediate layer comprises an expandable polymeric composition comprising a curable silicone composition comprising a liquid diorganopolysiloxane, a liquid organosilicon compound, a condensation catalyst and a blowing agent.

2. The golf ball of claim 1, wherein the liquid diorganopolysiloxane has a substantially linear molecular structure having at least two functional groups bonded to the silicon atoms in a molecule as the base polysiloxane.

3. The golf ball of claim 2, wherein the functional groups include silanolic hydroxy groups or alkenyl groups.

4. The golf ball of claim 2, wherein the functional groups in the base polysiloxane include hydroxy, vinyl, allyl, epoxy, and mercapto.

5. The golf ball of claim 1, wherein the liquid organosilicon compound has at least three functional groups bonded to the silicon atoms.

6. The golf ball of claim 5, wherein the functional groups include hydrogen or hydrolyzable groups.

7. The golf ball of claim 5, wherein the functional groups include hydrogen, vinyl, allyl, alkoxy, acyloxy, oxime, aminoxy or isopropenoxy.

8. The golf ball of claim 1, wherein the blowing agent comprises a low-boiling organic liquid encapsulated in a polyvinylidene chloride film in the form of microcapsules, in an amount from 1 to 200 parts by weight per 100 parts by weight of the curable silicone composition.

9. The golf ball of claim 1, wherein the blowing agent is a thermally decomposable organic blowing agent.

10. The golf ball of claim 1, wherein the blowing agent comprises water or an alcohol encapsulated with a silicone resin in the form of microcapsules.

* * * * *